US005490946A

United States Patent [19]

Beltzer et al.

[11] Patent Number: 5,490,946

[45] Date of Patent: Feb. 13, 1996

[54] ASHLESS BENZOTRIAZOLE-THIADIAZOL COMPOUNDS AS ANTI-OXIDANT, ANTI-WEAR AND FRICTION MODIFIERS IN LUBRICANTS AND THE LUBRICANTS CONTAINING SUCH COMPOUNDS

[75] Inventors: Morton Beltzer, Westfield; Manuel A. Francisco, Washington; John W. Frankenfeld, Hoboken, all of N.J.

[73] Assignee: Exxon Research and Engineering Company, Florham Park, N.J.

[21] Appl. No.: 328,206

[22] Filed: Oct. 25, 1994

[51] Int. Cl.[6] ..... C10M 133/44

[52] U.S. Cl. ..... 252/47; 252/402

[58] Field of Search ..... 252/47, 402

[56] References Cited

U.S. PATENT DOCUMENTS

| | | | |
|---|---|---|---|
| 2,764,547 | 9/1956 | Fields | 252/32.7 |
| 2,765,289 | 10/1956 | Fields et al. | 252/32.7 |
| 2,799,652 | 7/1957 | Fields | 252/32.7 |
| 2,850,453 | 9/1958 | Fields | 252/32.7 |
| 2,910,439 | 10/1959 | Fields | 252/46.7 |
| 4,764,298 | 8/1988 | Croudace | 252/47 |
| 4,990,273 | 2/1991 | Croudace | 252/46.4 |
| 4,997,585 | 3/1991 | Frankenfeld et al. | 252/50 |
| 5,051,198 | 9/1991 | Salomon | 252/47 |
| 5,143,634 | 9/1992 | Quinza et al. | 252/47 |
| 5,177,212 | 1/1993 | Karol et al. | 252/47 |
| 5,318,712 | 6/1994 | Lange et al. | 252/47 |

OTHER PUBLICATIONS

"The Response to Vapor Challenges of New Microsensor Coatings: Thiadiazole Derivatives" Katritzky et al, Chemica Scripta Aug. 1989 vol. 29, 315–317.

"S,S'–and S.N–Disubstituted Derivatives of 1,3, 4–Thiadiazoledithiones " Katritzky et al, J. Heterocyclic Chem. 27, 139–142, 1990 month unavailable.

*Primary Examiner*—Jacqueline V. Howard
*Attorney, Agent, or Firm*—Joseph J. Allocca

[57] ABSTRACT

Adducts of benzotriazole or substituted benzotriazole with formaldehyde or with thiadiazole or substituted thiadiazole are useful as ashless anti-wear/anti-friction/anti-oxidant additives for lubricants. Formulated lubricants containing such adducts exhibit compound levels of anti-wear, anti-friction and oxidation stability performance.

20 Claims, 3 Drawing Sheets

ASHLESS BENZOTRIAZOLE-THIADIAZOL COMPOUNDS AS ANTI-OXIDANT, ANTI-WEAR AND FRICTION MODIFIERS IN LUBRICANTS AND THE LUBRICANTS CONTAINING SUCH COMPOUNDS

BACKGROUND OF THE INVENTION

1. Field of the Invention

This invention relates to the improvement of the anti-wear, anti-friction and oxidation residence performance of lubricants by use of additives and to the formulated lubricants exhibiting such improved performance characteristics.

2. Related Art

Wear and friction are among the major concerns in operating machinery having metal to metal contracting of moving parts.

To insure the long life and continued usefulness of such machinery as well as to reduce down time for repairs it is necessary that wear and friction at the metal to metal interfaces be kept to a minimum. This is accomplished by the use of various lubricant materials. Typical lubricants are oils and greases obtained from hydrocarbon sources such as petroleum, tar sands, coal, shale oil, etc. and more recently include liquid hydrocarbons produced by the isomerization of natural or synthetic waxes.

Such hydrocarbon oil or grease materials, however, regardless of source, at some point encounter conditions which are outside their natural capabilities. Operation under high load, high temperature, and other hostile environmental conditions for extended periods of time have been found to require the use of additives to augment and supplement the natural lubricating abilities of hydrocarbon oil or grease.

Usually a combination of additive materials are employed in a careful balance to impart anti-wear, anti-friction, extreme pressure, anti-oxidant, anti-foaming, viscosity breakdown resistance, etc., capacity to the oil.

It is known, for example that various dimercapto-thiadiazole compounds are effective anti-wear and friction reducing additives for lubricating oils but they also exhibit corrosivity. To overcome this limitation dimercaptothiadiazol materials have been derivatized with other materials to produce compositions useful as corrosive inhibitors. Thus 2,5-dimercapto-1,3,4-thiadiazole have been reacted with diamines (U.S. Pat. No. 2,910,439), with formaldehyde and diarylamine (U.S. Pat. No. 2,765,289), with unsaturated ketone (U.S. Pat. No. 2,799,652), with unsaturated cyclic compounds (U.S. Pat. No. 2,764,547), and with formaldehyde and alcohol (U.S. Pat. No. 2,850,453) to produce derivatives useful as anti-corrosion additives.

U.S. Pat. No. 4,990,273 discloses an extreme pressure anti-wear additive which is the reaction product of 2,5-dimercapto-1,3,4-thiadiazole with oil solubilizing radicals. Preferably the additive is the reaction product of 2,5-dimercapto-1,3,4-thiadiazole with an aldehyde and a primary or secondary aliphatic or allcyclic amine.

U.S. Pat. No. 4,764,298 discloses an extreme pressure anti-wear additive soluble in lubricating oils which comprises the reaction product of a 2-mercaptobenzothiazole with (1) an aldehyde or ketone preferably having 1 to 10 carbon atoms and (2) ammonia or an amine, preferably an amine containing between 8 and 40 carbon atoms.

It is also known that benzotriazole is an excellent anti-corrosion agent but is of limited utility because of is low solubility in oil, rendering it useless in most lubricating oil applications.

In "The Response to Vapor Challenges of New Microsenser Coatings: Thiadiazole Derivatives" Katritsky et al, Chemica Scripta 1989, 29 315–317, various thiadiazole derivatives are described and their use as coatings for chemical microsensors by spray coating onto A Surface Acoustic Wave (SAW) device is investigated. Among the thiadiazole derivatives described is a benzotriazole-thiadiazole compound of the formula:

(1)

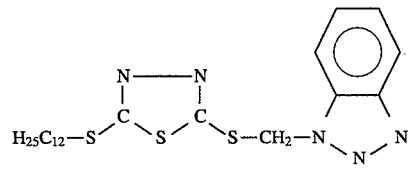

SUMMARY OF THE INVENTION

Figure 1:
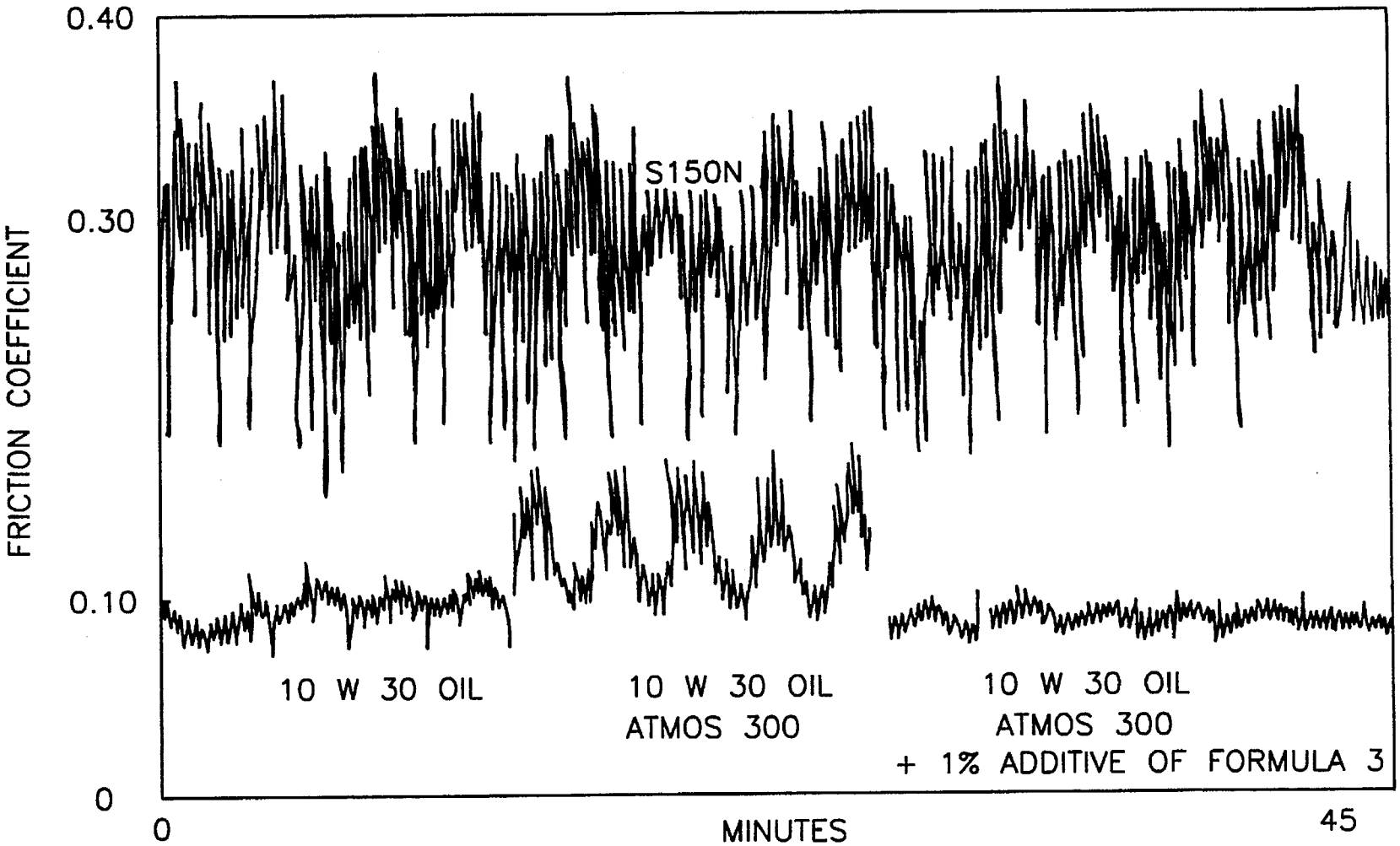
FIGS. 1, 2 and 3 compare the performance of different oils, with and without anti-friction additives, including additive of Formula 3 (below) in terms of anti-friction performance.

It has been discovered that the anti-wear, anti-friction and oxidation stability of a lubricating oil or grease can be improved by addition to said lubricating oil or grease of an effective amount of an adduct of benzotriazole or substituted benzotriazole, a $C_1$–$C_{20}$ aldehyde or ketone, e.g. formaldehyde, acetone, and thiadiazole or substituted thiadiazole.

Thus, it has been found that materials of the formula (2)

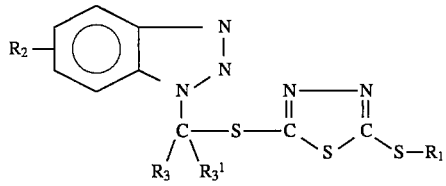

and (3)

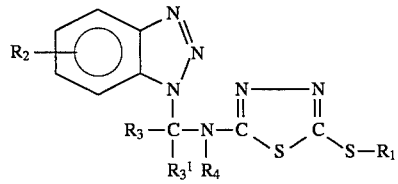

and mixtures thereof are useful as ashless, anti-friction and anti-wear additives to lubricating oils and greases which also exhibit anti-oxidant properties, and wherein $R_1$, $R_2$, $R_3$, $R_3{}^1$, and $R_4$ may be the same or different and are hydrogen or an alkyl group.

DETAILED DESCRIPTION OF THE INVENTION

The present invention is directed to a lubricant composition exhibiting improved anti-wear, anti-friction and oxidative stability and to a method for improving the anti-wear, anti-friction and oxiditive stability of lubricating oils and greases by addition to said lubricating oil or grease an effective amount of an adduct of benzotriazole or substituted benzotriazole, and a $C_1$–$C_{20}$ aldehyde or ketone and thiadiazole or substituted thiadiazole, as presented above and to the lubricant composition containing such adduct in combination with a major amount of lubricating base oil. Although the number of carbon atoms in the alkyl group of $R_2$–$R_4$ can vary broadly, the alkyl group in $R_2$–$R_4$ will generally contain from 1 to 20, preferably from 1 to 10 and more preferably from 1 to 4, while $R_1$ will preferably be an alkyl group containing from 10 to 20 carbons, more preferably 10 to 15 carbons. In addition, the alkyl groups $R_1$–$R_4$ may be straight or branched, but a straight carbon chain is preferred. Preferably $R_2$ is hydrogen or a straight chain alkyl group having from 1 to 4 carbon atoms, $R_3$ is a hydrogen and $R_4$ is a hydrogen, $CH_3$ or $C_2H_5$. If $R_2$ is an alkyl group the group should most preferably be in the 5 numbered position according to the structure shown below (which is the benzotriazole portion of structure 2 or 3).

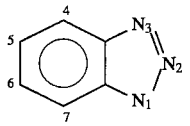

$R_1$ is preferably an alkyl group having 10–20 carbons, more preferably 10–15 carbons.

Compounds having structure 2 or 3 can be obtained for example by reacting benzotriazole (or a substituted benzotriazole) of the formula:

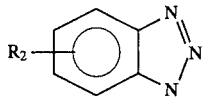

with a $C_1$–$C_{20}$ aldehyde or ketone such as formaldehyde, acetone etc with thiadiazole or substituted thiadiazole of the formula:

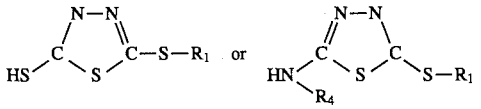

in an aqueous medium or in various solvents such as ethanol, methanol or benzene.

In general, the lubricant base stocks which are benefitted by having their anti-wear, anti-friction and oxidative stability performance improved by addition of an effective amount of the additive of formula 2 or formula 3 are any conventional natural petroleum base stocks as well as synthetic oil base stocks and mixtures thereof. In general the base stock oil or grease will be an oil of lubricating viscosity and have a kinematic viscosity ranging from about 5 to about 10,000 cSt @ 40° C., although typical applications will require that the formulated oil products have a viscosity ranging from about 10 to about 1000 cSt @ 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc. and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc. ); alkylated diphenyl ethers, alkylated diphenyl sulfides, as well as their derivatives, analogs, and homologs thereof and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500 ); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc. ) with a variety of alcohols (e.g. butyl alcohol, hexyl alcohol, dodecyl alcohol, 2-ethylhexyl alcohol, ethylene glycol, diethylene glycol monoether, propylene glycol, etc). Specific examples of these esters include dibutyl adipate, di (2-ethylhexyl) sebacate, di-n-hexyl fumarate, dioctyl sebacate, diisooctyl-azelate, diisodecyl azelate, dioctyl phthalate, didecyl phthalate, dieicosyl sebacate, the 21-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like.

Silicon-based oils (such as the polyalkyl-, polyaryl-, polyalkoxy-, or polyaryl oxy-siloxane oils and silicate oils) comprise another useful class of synthetic lubricating oils. These oils include tetraethyl silicate, tetraisopropyl silicate, tetra-(2-ethylhexyl) silicate, tetra-(4- methyl-2-ethylhexyl) silicate, tetra (p-tert-butylphenyl) silicate, hexa(4-methyl-2-pentoxy)-disiloxane, poly(methyl )-siloxanes and poly(methylphenyl ) siloxanes, and the like. Other synthetic lubricating oils include liquid esters of phosphorus-containing acids (e.g., tricresyl phosphate, trioctyl phosphate, diethyl ester of decyl -phosphonic acid), polymeric tetrahydrofurans, polyalphaolefins, and the like.

Another synthetic oil which can be benefitted from practice of the present invention is isomerate oil produced by the hydroisomerization of wax, such as slack wax or Fischer-Tigesche wax or other waxy feeds. Hydroisomerization of such feeds and catalysts useful in practicing such isomerization process are disclosed and claimed in U.S. Pat. Nos. 5,059,299; 5,158,671; 4,906,601; 4,959,337; 4,929,795; 4,900,707; 4,927,399; 4,919,786; 5,182,248; 4,943,622; 5,200,382; and 4,992,159.

The lubricating base oil may be derived from unrefined, refined, rerefined oils or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The benefits associated with the practice of the present invention, namely improved anti-wear, anti-friction, and oxidative stability performance can be achieved by adding material of formula 2 or formula 3 in an amount ranging from about 0.01 up to about 5 wt % or more (based on the total weight of the composition). Typically from about 0.01 to about 2 wt % of the additive will be used to insure sufficient concentrations of the additive and for economic considerations. Preferably the amount of additive used will range from about 0.2 to about 1.5 wt %, more preferably from about 0.4 to about 1.0 wt %.

Other additives may be present in the lubricant compositions of this invention as well, depending upon the intended use of the composition. Examples of other additives include ash-free detergents, dispersants, corrosion preventing agents, antioxidants, pour-point depressants, extreme pressure agents, viscosity improvers, colorants, antifoamers, and the like.

As used herein, "lubricant" (or "lubricant composition") is meant to include automotive lubricating oils, industrial oils, greases, and the like. For example, the lubricant compositions can be used in the lubrication system of essentially any internal combustion engine, including automobile and truck engines, two-cycle engines, aviation piston engines, marine and railroad engines, and the like. Also contemplated are lubricants for gas-fired engines, alcohol (e.g. methanol) powered engines, stationary powered engines, turbines, and the like.

However, the lubricant compositions are particularly useful in industrial oils such as turbine oils, gear oils, compressor oils, hydraulic fluids, spindle oils, high speed lubricating oils, process oils, heat transfer oils, refrigeration oils, metalworking fluids, and the like.

EXAMPLES

Additives within the description of formula 2 and formula 3 were evaluated for anti-wear/anti-friction, anti-oxidation and corrosion performance. The tests were conducted using a variety of lube oil base stocks and partially formulated lube oil formulations. The oils used were: an SAE 10W30 automotive engine oil having an absolute viscosity of 3500 centipoise at −20° C. and a kinematic viscosity between 9.3 and 12.5 cSt @ 100° C. without ZDDP (Zinc Dialkyl Dithio Phosphate, the universally used antiwear, antioxidant in automotive engine oils); a S150N which is a solvent 150 neutral oil made by solvent extraction, dewaxing and hydrofining a neutral lubricant base stock obtained from a paraffinic crude with a viscosity of 32 cSt @ 40° C., or equivalent 150 Saybolt Universal Seconds; an oil (Oil Sample A) which contains 9.5 wt % S150N, 17.8 wt % of a base stock having a kinematic viscosity of 129 cSt (or 600 Saybolt Universal Seconds), i.e. S600N @ 40° C., and 50 wt % of a polyalphaolefin having a viscosity of 6 cSt (or 45 SUS.) @ 40° C. Both the SAE10W30 and Oil Sample A average 22.7 wt % conventional lubricating oil additives but no ZDDP.

The additives employed comprised diluent oil (~0.90 wt %), antifoamant (~0.001 wt %), demulsifier (~0.005 wt %), diphenylamine (~0.18 wt %), Cu Polyisobutylene succinic anhydride (~0.82 wt %), hindered phenols (~0.60 wt %), Nonyl Phenol Sulfide (NPS) (~0.80 wt %), detergent (~2.2 wt %), dispersant (~9.0 wt %) and viscosity index improver (~8.2 wt %).

The above described oil samples were evaluated both with and without additives corresponding to formula 2 or formula 3 in a variety of standard performance tests.

Ball-on-cylinder Test

Experiments were performed in a ball-on-cylinder machine using a 12.5-mm-diameter stationary ball and a rotating cylinder 43.9 mm in diameter. Both components were made from oxygen-free tough pitch copper in the "as-received" condition. The hardness of the copper cylinder was 115 Vickers, whereas the copper balls had a Vickers hardness of 105. The copper balls were polished to centerline average roughness of 100 nm. Prior to tests, the copper balls were washed in a dilute solution of ammonium hydroxide ($NH_4OH$) to remove the surface oxide and were rinsed with distilled water. The cylinders, however, were polished on a SiC paper to a roughness of 400 nm after degreasing with 1,1,1,trichloroethane.

A normal force of 4.9 N was applied to the ball through dead weights, giving an initial mean Hertzian contact stress of 325 MPa. The friction force was continuously monitored through a load transducer by measuring the tangential force on the ball. The tests were performed for a duration of 30 minutes and the steady-state value of friction coefficient was determined from the friction-time plots. Replicate experiments indicated repeatability within 5–10 percent of the friction coefficients. In general, better repeatabilities were found at higher concentrations and for the more effective additives.

For the experiments reported here, a rotational speed of 0.25 rpm was used giving a surface speed of 0.5 mm/s. This surface speed was selected to insure boundary lubrication conditions and to minimize heat generation at the sliding contact. Since the tests were performed at room temperature of 20° C., it may be assumed that the contact temperature was also 20° C.

In the ball-on-cylinder geometry, the cylinder rotates inside a cup containing sufficient quantity of lubricant such that 2 mm of the cylinder is submerged. The lubricant is carried to the ball contact by rotation of the cylinder.

Rotary Bomb Oxidation Test (RBOT)

This test is described in ASTM D2272 and measures the effectiveness of an additive to deactivate a solid copper catalyst. In this test, the oil is oxidized in the copper wire catalyst and water. The "life" of the test oil is the time required for the oil to react with a given amount of oxygen. The longer the "life", the more stable the oil formulation (i.e. the more effective the antioxidant).

Universal Oxidation Test (UOT)

This is a high temperature oxidation test designed to determine the effectiveness of additives to deactivate a mixture of solid copper and iron catalysts. Air is blown through the oil at a rate of 3.0 liters/hr and at a temperature of 135° C. A water condenser is employed to condense volatile products. The effectiveness of the antioxidant is determined by measuring the time required for the acid titre of the oil to increase by 0.5 neutralization number (mg KOH/g oil). The longer the life, the more effective the antioxidant.

TABLE 1

FOUR BALL WEAR TESTS FOR NEW MULTIPURPOSE ADDITIVES

| Base Oil | Additive | Wear Volume ($mm^3 \times 10^4$) | % Reduction |
|---|---|---|---|
| 10W30 | None | 410 | — |
| S150N | None | 540 | — |
| Oil Sample A | None | 508 | — |
| 10W30 | Formula 3[1] ($R_1 = C_{12}H_{25}$; $R_3 + R_3^1 = H$; $R_4 = H$) | 13 | 97.7 |
| Oil Sample A | Formula 3[1] ($R_1 = C_{12}H_{25}$; $R_3 + R_3^1 = H$; $R_4 = H$) | 8 | 98.4 |
| S150N | Formula 2[1] ($R_1 = C_{12}H_{25}$; $R_3 + R_3^1 = H$; $R_4 = H$) | 24 | 96.0 |
| S150N | Formula 2[2] ($R_1 = C_{12}H_{25}$; $R_3 + R_3^1 = H$; $R_4 = H$) | 23 | 94.0 |

[1]1.0 wt %
[2]0.5 wt %

TABLE 2

ANTIOXIDANT PROPERTIES

| Base Blend | Additive | RBOT Life (Min) | UOT Life (Hr) |
|---|---|---|---|
| MIN Ad Pak[1] | None | 105 | 75 |
| MIN Ad Pak[1] | Formula 2[2] ($R_1 = C_{12}H_{25}$; $R_3 + R_3^1 = H$; $R_4 = H$) | 120 | 145 |
| MIN Ad Pak[1] | Formula 3[2] ($R_1 = C_{12}H_{25}$; $R_3 + R_3^1 = H$; $R_4 = H$) | 140 | 175 |

[1]Minimum treat industrial oil; consists of 0.2% a hydroxylated hindered phenol butylated hydroxy anisole, an antioxidant and 0.04% of the reaction product of tetrapropyl succinic anhydride and propylene glycol, a corrosion inhibitor.
[2].15 wt %

TABLE 3

RESULTS OF COPPER CORROSION TESTS - ASTM D-130

| Base Oil | Additive | Rating 100° C. | Rating 150° C. |
|---|---|---|---|
| S150N | None | 1A | 2A |
| S150N | Formula 3[1] ($R_1 = C_{12}H_{25}$; $R_3 + R_3^1 = H$; $R_4 = H$) | 1A | 2A |
| Oil Sample A | None | 2A | 2C |
| Oil Sample A | Formula 3[2] ($R_1 = C_{12}H_{25}$; $R_3 + R_3^1 = H$; $R_4 = H$) | 1A | 3A |

[1]0.4 wt %
[2]1.0 wt %

From these results it is seen that these additives impart significant anti-wear properties to lubricating oils as shown in Table 1. The data shown indicate that as little as 1.0% of additive of formula 3 will reduce wear better than 98%.

Figure 2:
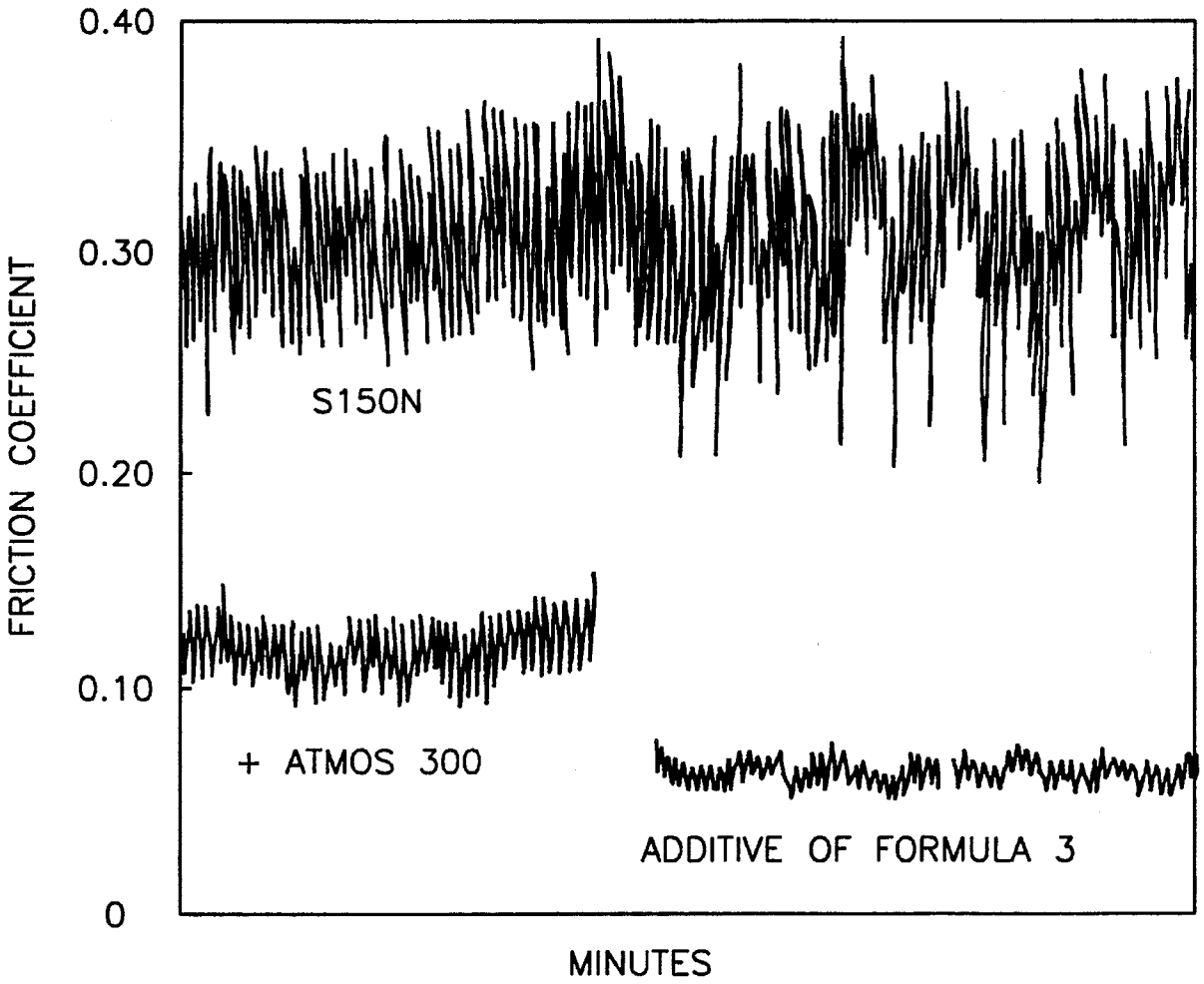
Figure 3:
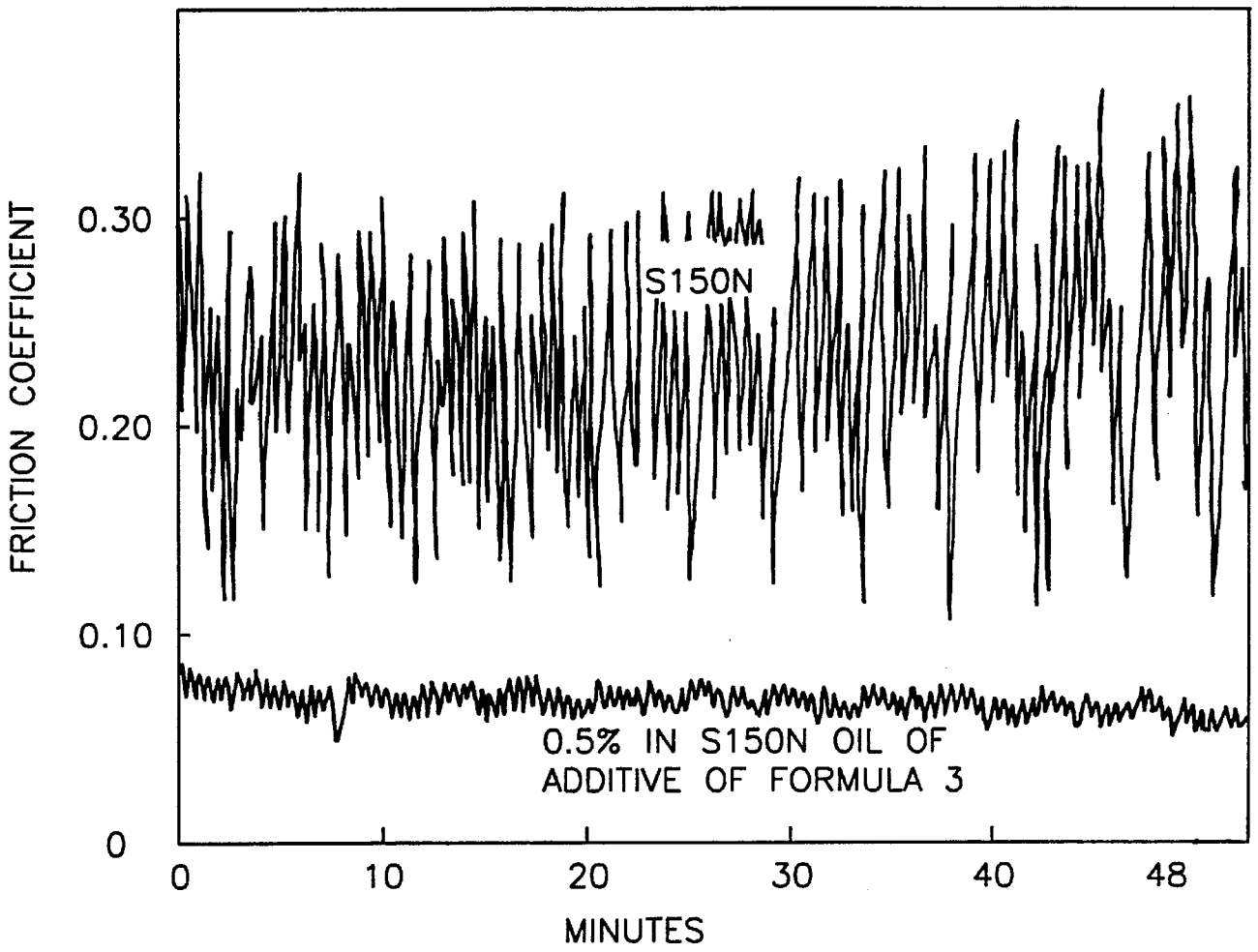

As is shown in FIGS. 1–3 in S15ON, the BOC friction coefficient with additive of formula 3 is a low 0.06, below that of ATMOS 300 in S15ON and equivalent to ATMOS 300 in 10W30-ZDDP. ATMOS 300 is one of the most common current commercial antifriction additives. ATMOS 300 is a commercial friction modifier used in passenger car engine oils and is comprised of 50% di-oleic acid ester of glycerine and 50% mono-oleic acid ester of glycerine. Additive of Formula 3 (where $R_1=C_{12}H_{25}$) is effective at concentration as low as 0.5%.

These compounds unexpectedly show antioxidant properties. The results of antioxidant tests are shown in Table 2. In both the Rotary Bomb Oxidation Test (RBOT) and the Universal Oxidation Test (UOT) long life times are desired. The compounds of this invention extended the oxidative lifetimes of a minimum treat oil by 14–33% in the RBOT and 93–133% in the UOT test.

Many antiwear additives are corrosive to metals. One of the major advantages in the use of these additives is that they are non-corrosive. The results of copper corrosion tests are shown in Table 3. Additive of Formula 3 did not promote copper corrosion in either of the base stocks tested.

What is claimed is:

1. A lubricant composition comprising a major amount of a laboratory base oil and a minor amount of an additive selected from

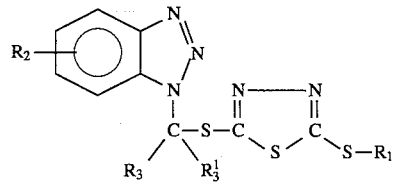

and

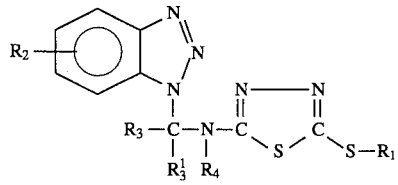

and mixtures thereof wherein $R_1$, $R_2$, $R_3$, $R_3^1$ and $R_4$ may be the same or different and are hydrogen or an alkyl group.

2. The composition of claim 1 wherein the alkyl groups of $R_2$–$R_4$ each have from 1 to 20 carbons.

3. The composition of claim 1 wherein the alkyl groups of $R_2$–$R_4$ each have from I to 10 carbons.

4. The composition of claim 1 wherein the alkyl group of $R_2$–$R_4$ each have from 1 to 4 carbons.

5. The composition of claim 1, 2, 3 or 4 wherein $R_1$ is an alkyl group containing from 10 to 20 carbons.

6. The composition of claim 5 wherein $R_1$ is an alkyl group containing from 10 to 15 carbons.

7. The composition of claim 1 wherein $R_2$ is hydrogen or a straight chain alkyl group having 1 to 4 carbons, $R_3$ and $R_3^1$ are is hydrogen, $R_4$ is hydrogen or $CH_3$ or $C_2H_5$.

8. The composition of claim 1 wherein from about 0.01 to about 5 wt % of the additive is present in the composition.

9. A lubricant composition comprising a major amount of an oil of lubricating viscosity and from about 0.01 to about 5 wt % of an additive selected from

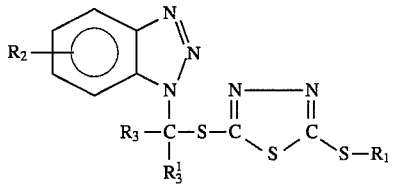

and

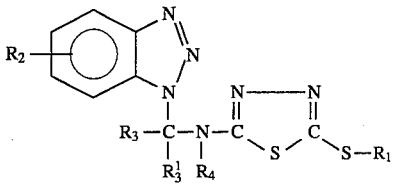

and mixtures thereof wherein $R_1$ is an alkyl group containing from 10 to 20 carbons, $R_2$ is hydrogen or a straight chain alkyl group containing from 1 to 4 carbons $R_3$ and $R_3^1$ are hydrogen $R_4$ is hydrogen or $CH_3$ or $C_2H_5$,

10. The lubricant composition of claim 9 wherein from about 0.01 to 2.0 wt % of the additive is present in the composition.

11. The lubricant composition of claim g wherein $R_1$ is $C_{12}H_{25}$, $R_2$ is hydrogen $R_3$ and $R_3^1$ are hydrogen and $R_4$ is hydrogen.

12. A method for improving the anti-wear, anti-friction and oxidation stability of lubricating oils or greases by addition to said lubricating oil or grease an effective amount of an additive selected from

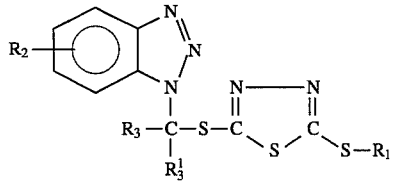

-continued and

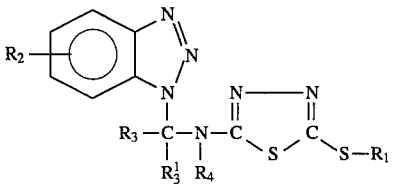

and mixtures thereof wherein $R_1$, $R_2$, $R_3$, $R_3^3$ and $R_4$ may be the same or different and are hydrogen or an alkyl group.

13. The method of claim 12 wherein the alkyl group of $R_2$–$R_4$ each contain from 1 to 20 carbons.

14. The method of claim 12 wherein the alkyl groups of $R_2$–$R_4$ each contain from 1 to 10 carbons.

15. The method of claim 12 wherein the alkyl group of $R_2$–$R_4$ each contain from 1 to 4 carbons.

16. The method of claim 12 wherein $R_1$ is an alkyl group containing from 10 to 20 carbons, $R_2$ is hydrogen or a straight chain alkyl group containing from 1 to 4 carbons, $R_3$ and $R_3^1$ are hydrogen and $R_4$ is hydrogen or $CH_3$ or $C_2H_5$.

17. The method of claim 12 wherein $R_1$ is $C_{12}H_{25}$, $R_2$ is hydrogen, $R_3$ and $R_3^1$ are hydrogen and $R_4$ is hydrogen.

18. The method of claims 12, 13, 14, 15, 16 or 17 wherein the additive is used in an amount in the range 0.01 to 5.0 wt %.

19. The method of claim 18 wherein the additive is used in an amount in the range 0.01 to 2 wt %.

20. The method of claim 18 wherein the additive is used in an amount in the range 0.4 to 1.0 wt %.

* * * * *